US006942549B2

(12) United States Patent
Khoury

(10) Patent No.: US 6,942,549 B2
(45) Date of Patent: Sep. 13, 2005

(54) TWO-SIDED CHEMICAL MECHANICAL POLISHING PAD FOR SEMICONDUCTOR PROCESSING

(75) Inventor: Raymond M. Khoury, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/605,828

(22) Filed: Oct. 29, 2003

(65) Prior Publication Data

US 2005/0095957 A1 May 5, 2005

(51) Int. Cl.[7] ..... B24B 1/00; B24D 11/00
(52) U.S. Cl. ..... 451/41; 451/539; 451/526
(58) Field of Search ..... 451/41, 54, 60, 451/283–288, 446, 526–537

(56) References Cited

U.S. PATENT DOCUMENTS

| | | | | |
|---|---|---|---|---|
| 5,212,910 A | | 5/1993 | Breivogel et al. | |
| 5,533,923 A | | 7/1996 | Shamouilian et al. | |
| 5,725,420 A | * | 3/1998 | Torii | 451/285 |
| 5,876,271 A | * | 3/1999 | Oliver | 451/60 |
| 5,882,251 A | | 3/1999 | Berman et al. | |
| 6,120,366 A | | 9/2000 | Lin et al. | |
| 6,458,023 B1 | | 10/2002 | Moon | |
| 6,572,446 B1 | | 6/2003 | Osterheld et al. | |
| 6,623,337 B2 | | 9/2003 | Scott et al. | |
| 6,656,019 B1 | * | 12/2003 | Chen et al. | 451/41 |
| 6,685,548 B2 | * | 2/2004 | Chen et al. | 451/526 |
| 6,692,338 B1 | * | 2/2004 | Kirchner | 451/41 |
| 2003/0034131 A1 | | 2/2003 | Park et al. | |

FOREIGN PATENT DOCUMENTS

| | | | | |
|---|---|---|---|---|
| JP | 2002028849 A | * | 1/2002 | B24B/37/00 |
| JP | 2003334753 A | * | 11/2003 | B24B/37/00 |
| WO | WO 3017348 A1 | * | 2/2003 | H01L/21/304 |

* cited by examiner

*Primary Examiner*—David B. Thomas
(74) *Attorney, Agent, or Firm*—Lisa U. Jaklitsch; Cantor Colburn LLP

(57) ABSTRACT

A chemical mechanical polishing (CMP) pad includes a unitary body having a first side and a second side, the first side having a plurality of holes formed therein, and the second side having a plurality of grooves formed therein. Each of the plurality of holes in the first side is aligned with one of the plurality of grooves in the second side.

3 Claims, 5 Drawing Sheets

TWO-SIDED CHEMICAL MECHANICAL POLISHING PAD FOR SEMICONDUCTOR PROCESSING

BACKGROUND OF INVENTION

The present invention relates generally to semiconductor device processing and, more particularly, to a two-sided chemical mechanical polishing pad for semiconductor processing.

Many electronic and computer-related products such as semiconductors, hard disks and CD-ROMS require highly polished or planarized surfaces in order to achieve optimum performance. In the semiconductor manufacturing industry, for example, silicon workpieces are used in the manufacture of integrated circuit components and the like. The workpieces are known in the industry as "wafers" and typically have a flat, circular disk-like shape. The wafers are initially sliced from a silicon ingot and, thereafter, undergo multiple masking, etching, and layer (e.g., dielectric and conductor) deposition processes to create microelectronic structures and circuitry on the wafers. The surface of a wafer undergoing these processes is typically polished or planarized between processing steps to ensure proper flatness, thereby permitting use of subsequent photolithographic processes for building additional dielectric and metallization layers on the wafer surface.

Accordingly, chemical mechanical planarization or Polishing (CMP) machines have been developed to planarize or polish silicon wafer surfaces to a flat condition suitable for manufacture of integrated circuit components and the like. More specifically, CMP is a manufacturing process performed by a polishing pad in combination with a polishing fluid (slurry) to polish, for example, a silicon wafer having metal circuits embedded in trenches in a substrate of the wafer. The polishing pad is mounted on a platen of a known polishing apparatus. A base pad is positioned between the polishing pad and the platen.

A conventional base pad is formed from foamed sheets or felts impregnated with a polymeric material. However, such a base pad is too compliant when subjected to the forces occurring during a polishing operation, which can cause the pad to settle into recesses in the substrate that is being polished, which, in turn, causes excessive polishing. As a result, the surfaces of the embedded circuits become polished excessively, causing unwanted recesses known as dishing. Further, such a base pad absorbs polishing fluid, and is compressed during a polishing operation such that it becomes deformed in all directions, causing the pad to become too compliant. A measure of the compressibility in such different directions provides a prediction that the base pad will deform in such different directions due to the application of forces.

Consequently, as a result of problems such as wafers sticking to pads at the end of the CMP run (resulting from surface tension between the wafer and the pad), a second pad has been used underneath the first pad, wherein the first pad is perforated entirely there through while the second pad includes a plurality of grooves or channels. However, by using separate first and second pads, there is an additional cost associated therewith. Moreover, when the first and second pads are manually aligned (as is done in the conventional manner), the possibility arises that the perforations (holes) in the first pad do not all align with a corresponding groove in the second pad. This, in turn, may have an adverse impact on process yield variations.

SUMMARY OF INVENTION

The foregoing discussed drawbacks and deficiencies of the prior art are overcome or alleviated by a chemical mechanical polishing (CMP) pad. In an exemplary embodiment, the pad includes a unitary body having a first side and a second side, the first side having a plurality of holes formed therein, and the second side having a plurality of grooves formed therein. Each of the plurality of holes in the first side is aligned with one of the plurality of grooves in the second side.

In another aspect, a chemical mechanical polishing (CMP) pad assembly includes a sub pad attached to the upper surface of a support turntable, and a CMP pad having unitary body with a first side and a second side, wherein the first side is in contact with the sub pad. The first has a plurality of holes formed therein, and the second side has a plurality of grooves formed therein. Each of the plurality of holes in the first side is aligned with one of the plurality of grooves in the second side.

In still another aspect, a chemical mechanical polishing (CMP) assembly includes a rotatable pressure block for securing a semiconductor wafer therein, and a support turntable having a sub pad attached to the upper surface thereof. A CMP pad has unitary body with a first side and a second side, wherein the first side is in contact with the sub pad and said the side is disposed so as to come into contact with the semiconductor wafer during a polishing operation. At least one supply line is for dispensing CMP fluid for the polishing operation. The first side of the CMP pad has a plurality of holes formed therein, and the second side of said CMP pad has a plurality of grooves formed therein.

BRIEF DESCRIPTION OF DRAWINGS

Referring to the exemplary drawings wherein like elements are numbered alike in the several Figures:

FIG. 4(*b*) cross-sectional view of the embodiment of the CMP pad of FIGS. 3 and 4(*a*), taken along line B—B of FIG. 3;

FIG. 4(*c*) is another view of FIG. 4(*b*), further illustrating the relative positioning of the holes and grooves of the CMP pad;

FIG. 5(*b*) cross-sectional view of the embodiment of the CMP pad of FIGS. 3 and 5(*a*), taken along line B—B of FIG. 3; and FIG. 5(*c*) is another view of FIG. 5(*b*), further illustrating the relative positioning of the holes and grooves of the CMP pad.

DETAILED DESCRIPTION

Disclosed herein is a two-sided chemical mechanical polishing pad for chemical-mechanical polishing (or chemical-mechanical planarization) (CMP) of a semiconductor substrate and device materials upon that substrate. In general, a semiconductor wafer can be polished to remove high topography, surface defects such as crystal lattice damage, scratches, roughness, or embedded particles of dirt or dust. Frequently, the polishing process involves the introduction of a chemical slurry or reactive etchant material to facilitate more rapid polishing rates.

More specifically, the CMP process involves holding and rotating a thin flat substrate comprising a semiconductor device against a wetted polishing surface under controlled temperature and pressure. Alternatively, the substrate can be held stationary against a rotating, wetted polishing surface, or both the substrate and polishing surface can be moving. The polishing surface may be larger or smaller than the substrate surface, although it is preferable to have a polishing surface larger than the substrate surface to prevent edge effects from the polishing surface acting upon the substrate. Typically, the polishing surface is at about 8 inches or more in diameter, and for specialized applications, the polishing surface may have a diameter as large as about 24 inches.

Figure 1:
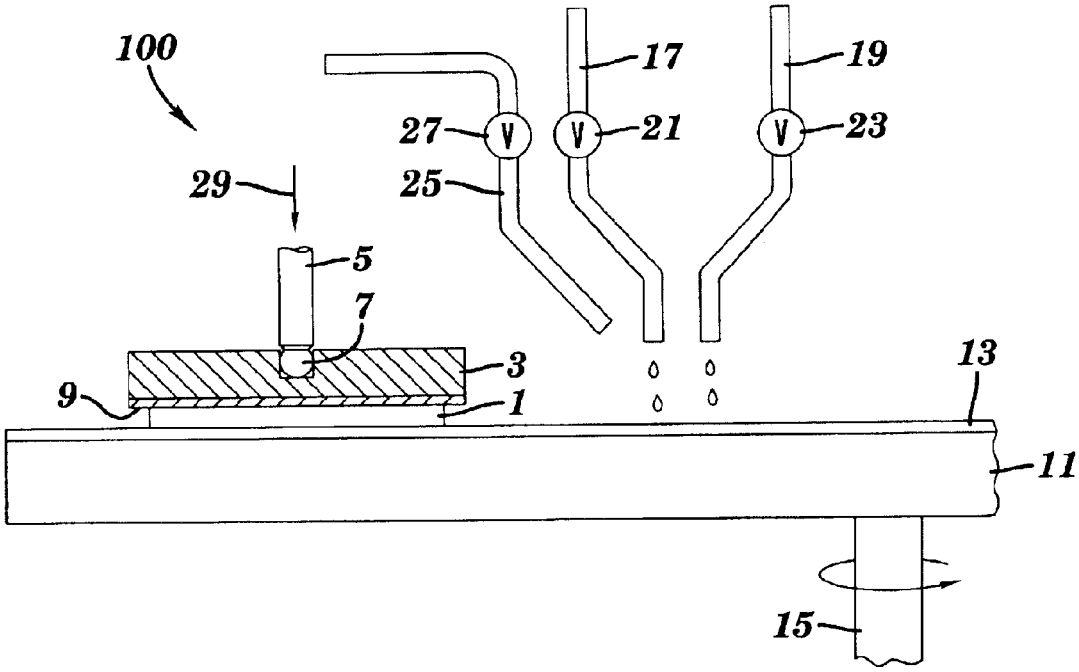
FIG. 1 illustrates an exemplary chemical mechanical polishing (CMP) apparatus, suitable for use in accordance with an embodiment of the invention.

Referring initially to FIG. 1, there is shown an exemplary CMP apparatus 100, suitable for use in accordance with an embodiment of the invention. It will be appreciated, however, that the apparatus 100 represents a single example of a CMP system in which the present pad structure may be implemented, and thus should not be construed in any limiting sense.

As shown in FIG. 1, the CMP apparatus 100 illustrates a semiconductor wafer 1 that is placed under a pressure block 3, which in turn is carried by a freely rotatable spindle 5 that rotates about a pivot 7. A retention pad 9 for protection and for preventing slippage between the pressure block 3 and the wafer 1 is positioned between the wafer 1 and the block 3. Turntable 11 carrying a fixed polishing pad 13 is driven by a motor (not shown) about spindle 15. Thus, the turntable 11 and wafer 1 rotate in the same direction. The etching components and/or slurry are metered onto the polishing pad 13 through supply lines 17 and 19, for example. Valves 21 and 23 are used to control relative flow rates of etching components and/or slurry from lines 17 and 19, respectively. Rinse water can be supplied to the turntable 11 through line 25, the flow thereof being regulated by valve 27.

During the polishing operation, a positive pressure is applied through the wafer 1 normal to the turntable 11, as indicated by arrow 29. The pressure may range from about 10 to about 100 pounds per square inch of wafer 1 surface area in contact with turntable 11. The temperature of the aqueous solution employed as well as temperature of the surrounding atmosphere can be controlled depending on criticality. Typically, such temperature is maintained at about room temperature, i.e., about 20E C to about 25E C, although higher temperatures may occur at higher polishing rates, depending on the heat transfer means used to remove the heat as it is generated.

Figure 2:
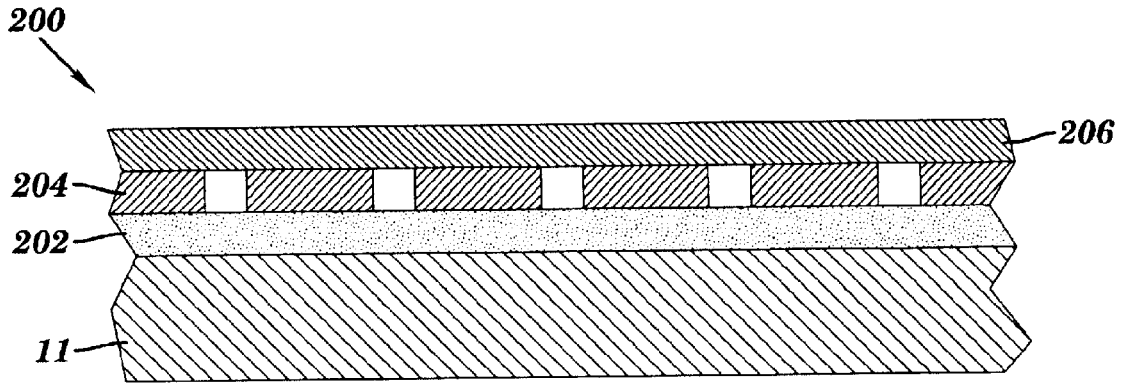
FIG. 2 PRIOR ART
FIG. 2 is a cross-sectional view of one type of conventional, composite CMP pad.

Referring now to FIG. 2, there is shown a cross-sectional view of one type of conventional, composite polishing pad 200 (initially represented by reference numeral 13 in FIG. 1). Composite pad 200 includes three distinct layers, the combination of which allows optimization of a number of independent polishing parameters. The first layer is a sub pad 202 that comprises a relatively soft, elastic material attached to the upper surface of support turntable 11. The sub pad 202 may include, for example, a silicone sponge rubber or foam rubber having a thickness on the order of about one millimeter. Next, a second layer of rigid material defines a support pad 204 that covers the top of the sub pad 202. A plurality of spaces or channels 29 may be provided within the support pad 204. In one embodiment, the second layer (support pad 204) comprises a composite fiberglass epoxy material, which is well known for its extreme rigidity and hardness. The thickness of the support pad 204 may be on the order of about one millimeter thick.

The third or upper most layer of the composite pad 200 is a polishing pad 206 comprising a spongy, porous material which functions as a slurry carrier. Since the polishing pad 206 is in contact with the silicon surface of the wafer during planarization processing, it needs to be capable of transporting slurry across the wafer. Accordingly, the polishing pad 206 is open celled or porous in nature. Moreover, polishing pad 206 is generally highly flexible so as to be able to conform to the localized incongruities of the silicon substrate surface. A suitable example of a polishing pad material is manufactured by Rodel, and is known by the name "SUBA-500". The thickness of the polishing pad 206 may in the range of about 0.1 to about 2.0 millimeters. However, other applications may employ thicknesses beyond this range. Additional information regarding the three-layer composite pad 200 may be found in U.S. Pat. No. 5,212,910 to Breivogel, et al, the contents of which are incorporated herein by reference in their entirety.

Figure 3:
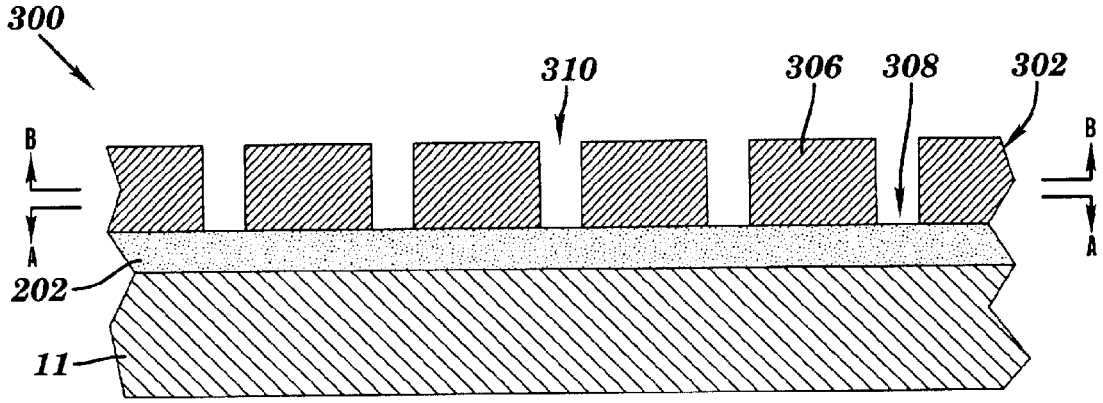
FIG. 3 is a cross-sectional view of a two-sided, composite CMP pad, in accordance with an embodiment of the invention.

Referring now to FIG. 3, there is shown a two-sided, composite CMP pad 300, in accordance with an embodiment of the invention. In contrast to the three-layer pad of FIG. 2, the pad 300 of the present invention features a two-sided pad (in addition to the sub pad) that integrates both the support and polishing layers into a single pad. In this manner, one side of the pad provides a stiffer support function, while the other provides a spongy, porous surface for polishing. In particular, pad 300 includes a unitary body 302 having a first side 304 and a second side 306. In one embodiment, the body 302 of the pad 300 may be formed from a single pad material (e.g., a spongy porous material) or, alternatively, by using two types of material in a single mold.

Disposed within the first side 304 of pad 300 is a plurality of holes 308 that are arranged so as to be aligned with one of a plurality of grooves or channels 310 disposed on the second side 306 of the pad 300. The holes 308 are further sized in a manner such that they are no larger than the width of the grooves 310 on the opposite side of the pad 300. Moreover, by having the holes 308 on the first side 304 aligned with one of the grooves 310 on the second side 306 of the pad 300, the uniformity of the slurry flow underneath the wafer is improved since none of the holes are "dead-ended" and not providing a path for airflow.

The particular arrangement of holes and groves within opposing sides of the pad may be implemented in a number of different ways. For example, FIG. 4(*a*) is a cross-sectional view of one possible embodiment of the CMP pad 300 of FIG. 3, taken along line A—A, and particularly illustrating an arrangement pattern of holes 308 formed within the first side 304 of the pad 300. As is shown, the holes 308 are disposed in a generally concentric circular configuration within the first side 304 of the pad 300. Although the holes 308 in FIG. 4(*a*) are depicted as being distributed about the entire area of the first side 304 of pad 300, this need not be the case. In other words, the holes may be localized within a smaller area of the pad 300, representing the actual polishing area. While the specific number of holes present within the polishing area of the pad 300 may be varied, it is preferred that the distribution of holes present within the polishing area be fairly uniform.

Figure 4A:
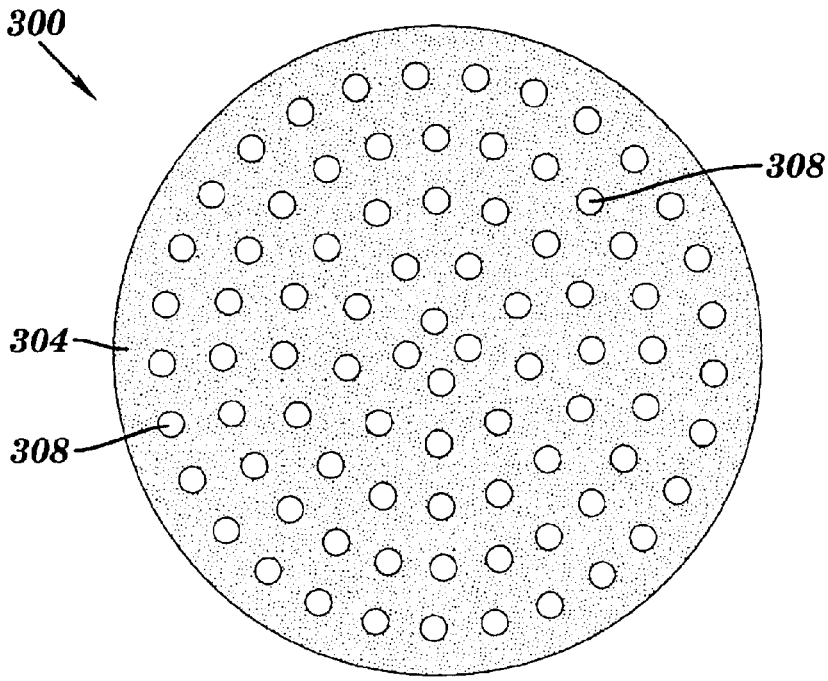
FIG. 4(*a*) is a cross-sectional view of one possible embodiment of the CMP pad of FIG. 3, taken along line A—A.
Figure 4B:
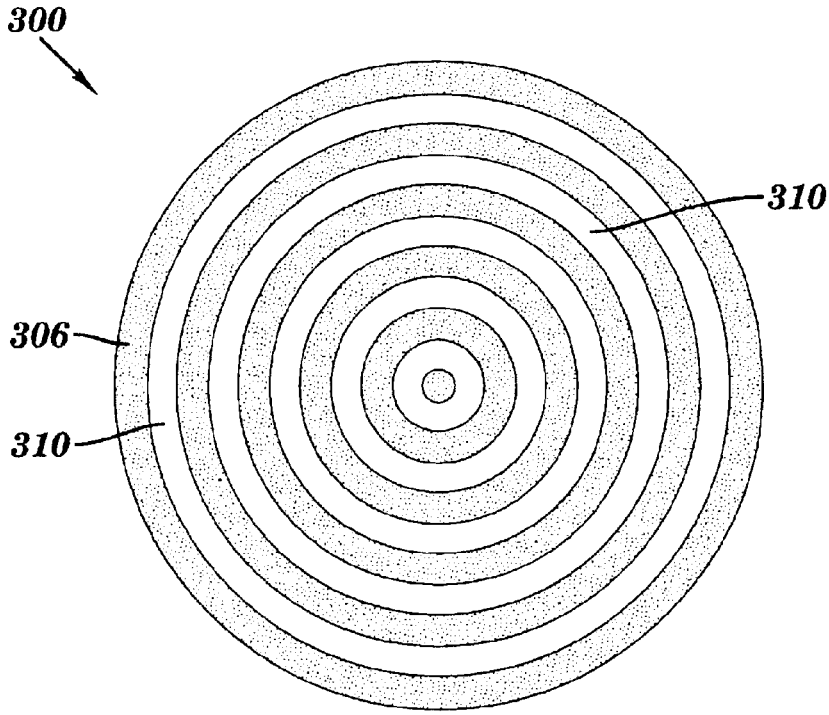
Figure 4C:
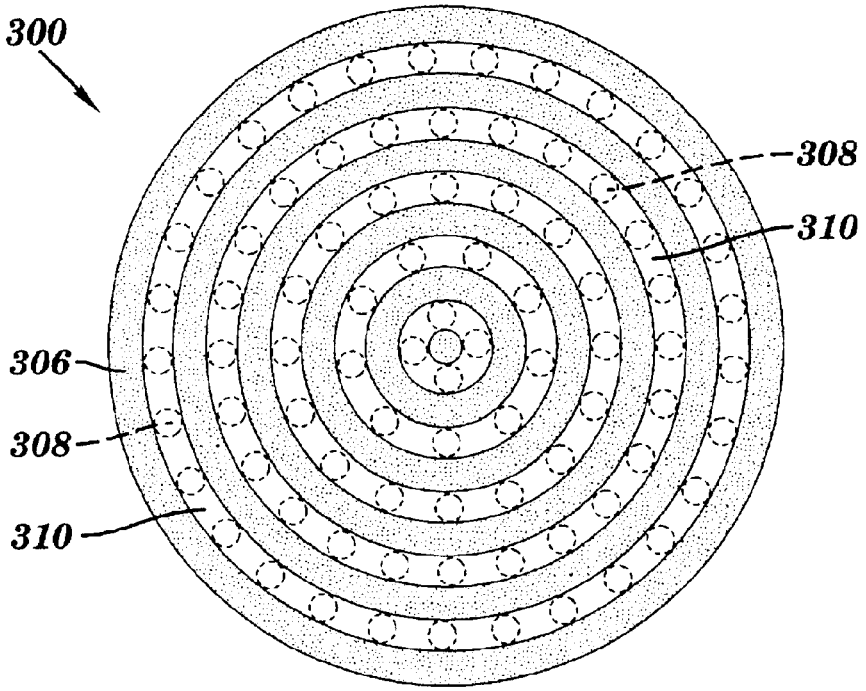

FIG. 4(*b*) illustrates the corresponding arrangement of grooves 310 formed within the second side 306 of the pad 300 by showing a cross-sectional view taken along line B—B of FIG. 3. In this embodiment, the grooves 310 are also formed in a concentric circle arrangement on the second side 306 of pad 300. As is the case with the hole formation, the formation of grooves 310 need not encompass the entire area of the second side 306 of pad 300 (as is shown in FIG. 4(*b*)), but could be localized to the polishing area of the pad 300.

FIG. 4(*c*) is another view of FIG. 4(*b*), further illustrating the relative positioning of the holes 308 and grooves 310 of the CMP pad. As can be seen, the concentric circular configuration of both the holes 308 and the grooves 310 results in alignment between each hole 308 and one of the grooves 310.

Figure 5A:
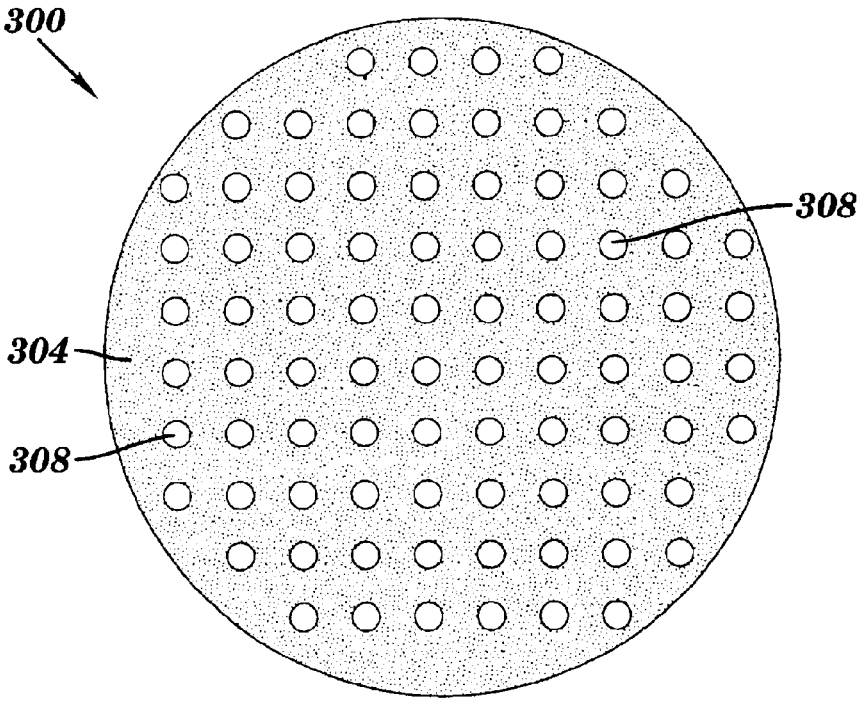
FIG. 5(*a*) is a cross-sectional view of another possible embodiment of the CMP pad of FIG. 3, taken along line A—A.
Figure 5B:
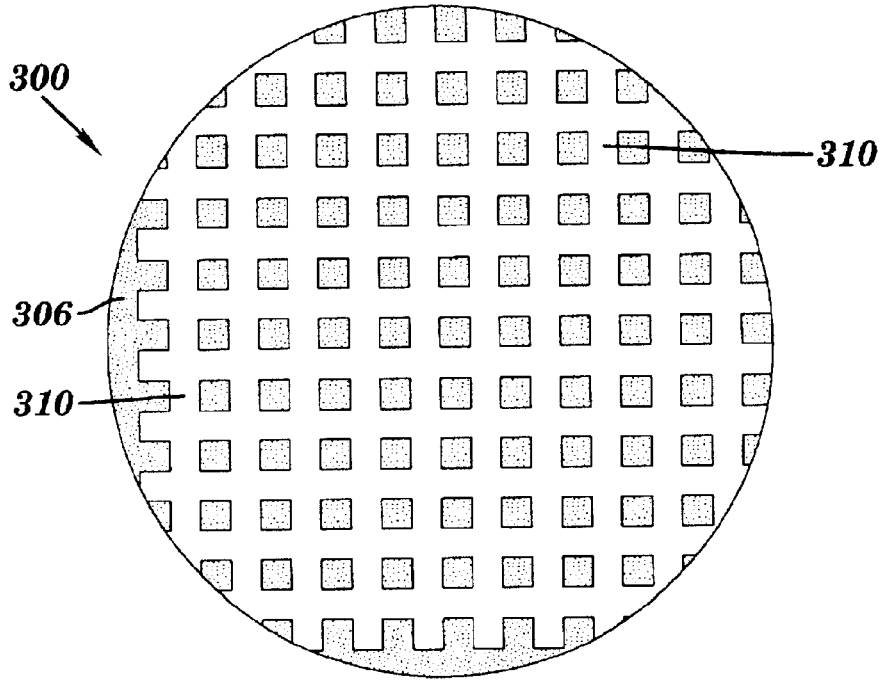
Figure 5C:
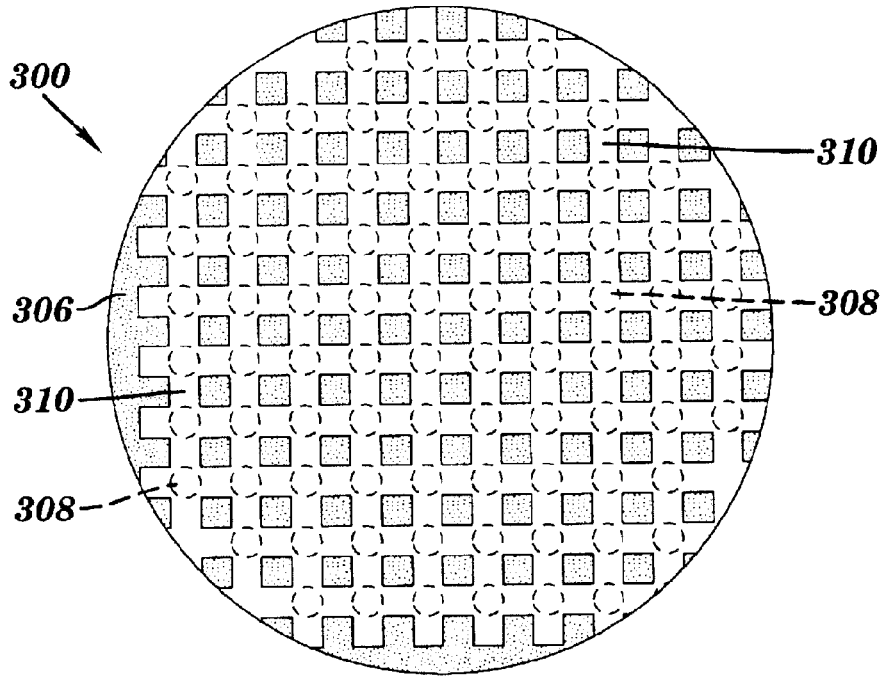

Referring now to FIG. 5(*a*), there is a shown cross-sectional view of another possible embodiment of the CMP pad 300 of FIG. 3, again taken along line A—A, and particularly illustrating another arrangement pattern of holes 308 formed within the first side 304 of the pad 300. As is shown, the holes 308 are disposed in a generally X-Y grid configuration within the first side 304 of the pad 300. Again, while the holes 308 in FIG. 5(*a*) are depicted as being distributed about the entire area of the first side 304 of pad 300, this need not be the case.

The second side 306 of the embodiment of FIG. 5(*a*) is illustrated in the cross-sectional view of FIG. 5(*b*), which is taken along line B—B of FIG. 3. In this embodiment, the grooves 310 are also formed in an X-Y grid arrangement on the second side 306 of pad 300. Finally, as shown in FIG. 5(*c*), the relationship between the location of the holes 308 and the grooves 310 of the X-Y embodiment is illustrated. Again, each hole 308 is located so as to align with one of the grooves 310.

As will be appreciated, the use of a single two-sided pad, having one side perforated through and the backside grooved or channeled, will provide the same benefit as the conventional three layer CMP pad, but with an additional process flexibility.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A chemical mechanical polishing (CMP) pad, comprising:

a unitary body having a first side and a second side, said second side being a polishing side;

said first side having a plurality of holes formed therein, arranged into a concentric circular configuration; and said second side having a plurality of grooves formed therein, arranged into a concentric circular configuration;

wherein each of said plurality of holes in said first side is aligned with one of said plurality of grooves in said second side;

the depth of each of said plurality of holes extends up to said one of said plurality of grooves; and each of said holes are sized in a manner so as not to exceed the width of a corresponding groove aligned therewith.

2. A chemical mechanical polishing (CMP) pad assembly, comprising:

a sub pad attached to the upper surface of a support turntable;

a CMP pad having unitary body with a first side and a second side, said second side being a polishing side, wherein said first side is in contact with said sub pad;

said first side having a plurality of holes formed therein, arranged into a concentric circular configuration; and said second side having a plurality of grooves formed therein, arranged into a concentric circular configuration wherein each of said plurality of holes in said first side is aligned with one of said plurality of grooves in said second side;

the depth of each of said plurality of holes extends up to said one of said plurality of grooves; and each of said holes are sized in a manner so as not to exceed the width of a corresponding groove aligned therewith.

3. A chemical mechanical polishing (CMP) assembly, comprising:

a rotatable pressure block for securing a semiconductor wafer therein;

a support turntable having a sub pad attached to the upper surface thereof;

a CMP pad having unitary body with a first side and a second side, wherein said first side is in contact with said sub pad and said second side is disposed so as to come into contact with said semiconductor wafer during a polishing operation; and at least one supply line for dispensing CMP fluid for said polishing operation;

wherein said first side of said CMP pad has a plurality of holes formed therein, arranged into a concentric circular configuration, and said second side of said CMP pad has a plurality of grooves formed therein, arranged into a concentric circular configuration; and wherein each of said plurality of holes in said first side is aligned with one of said plurality of grooves in said second side;

the depth of each of said plurality of holes extends up to said one of said plurality of grooves; and each of said holes are sized in a manner so as not to exceed the width of a corresponding groove aligned therewith.

* * * * *